US006716112B2

(12) United States Patent
Rennecamp

(10) Patent No.: US 6,716,112 B2
(45) Date of Patent: Apr. 6, 2004

(54) GOLF BALL MARKING GUIDE

(75) Inventor: Bryan R. Rennecamp, 5621 Delmar Ave., Apt. 812, St. Louis, MO (US) 63112

(73) Assignee: Bryan R. Rennecamp, St. Louis, MO (US)

( * ) Notice: Subject to any disclaimer, the term of this patent is extended or adjusted under 35 U.S.C. 154(b) by 0 days.

(21) Appl. No.: 10/207,290

(22) Filed: Jul. 29, 2002

(65) Prior Publication Data

US 2003/0022724 A1 Jan. 30, 2003

Related U.S. Application Data

(60) Provisional application No. 60/308,533, filed on Jul. 30, 2001.

(51) Int. Cl.[7] ..... A63B 69/36
(52) U.S. Cl. ..... 473/257; 101/127
(58) Field of Search ..... 473/257, 237, 473/280, 285, 406; 220/DIG. 31, 4.02, 4.6, 4.21, 4.22, 4.23, 4.25, 4.24; 101/127, DIG. 40, 4, 5, 35, 114

(56) References Cited

U.S. PATENT DOCUMENTS

| | | | | |
|---|---|---|---|---|
| 676,506 | A | | 6/1901 | Knight et al. |
| 849,600 | A | | 4/1907 | Cory |
| 943,851 | A | | 12/1909 | West |
| 1,045,340 | A | | 11/1912 | Supplee |
| 1,096,084 | A | | 5/1914 | West |
| 1,139,689 | A | | 5/1915 | Lyon |
| 1,228,736 | A | | 6/1917 | Bacheller et al. |
| 1,286,205 | A | | 12/1918 | Beaver |
| 1,339,569 | A | | 5/1920 | Lyon |
| 1,390,926 | A | | 9/1921 | Reach |
| 1,427,461 | A | | 8/1922 | Henderson |
| 1,476,203 | A | | 12/1923 | Horne |
| 1,527,691 | A | | 5/1925 | McNab et al. |
| 1,537,685 | A | | 5/1925 | Ladd |
| 1,641,562 | A | | 9/1927 | Will et al. |
| 1,814,170 | A | | 7/1931 | Long |
| 1,814,312 | A | | 7/1931 | Heene |
| 1,842,944 | A | | 7/1932 | O'Brien |
| 1,921,571 | A | | 8/1933 | Jones |
| 1,953,992 | A | | 4/1934 | Seagers |
| 1,999,647 | A | | 4/1935 | Atti |
| 2,709,595 | A | | 5/1955 | De Vries |
| 3,019,762 | A | * | 2/1962 | Hautz ..... 401/78 |
| 3,161,041 | A | * | 12/1964 | Amburgey ..... 73/65.02 |
| 3,420,529 | A | | 1/1969 | Goranson et al. |
| 3,647,221 | A | | 3/1972 | Holley |
| 3,753,565 | A | | 8/1973 | Baker |
| 4,086,851 | A | | 5/1978 | Brandell |
| 4,209,172 | A | | 6/1980 | Yamamoto |
| 4,258,921 | A | | 3/1981 | Worst ..... 273/232 |
| 4,441,716 | A | | 4/1984 | Chen ..... 273/183 |
| 4,803,922 | A | | 2/1989 | Dennesen et al. ..... 101/41 |
| 4,974,511 | A | | 12/1990 | Hsi-Chou ..... 101/38.1 |
| 5,564,707 | A | | 10/1996 | Dinh ..... 473/218 |
| 5,662,530 | A | | 9/1997 | Sellar ..... 473/268 |
| 6,004,223 | A | | 12/1999 | Newcomb |
| 6,324,971 | B1 | * | 12/2001 | Urban ..... 101/35 |
| 6,422,949 | B1 | * | 7/2002 | Byrne et al. ..... 473/200 |
| 6,453,807 | B1 | * | 9/2002 | Ramey ..... 101/35 |
| D471,608 | S | * | 3/2003 | Hettinger et al. ..... D21/708 |

OTHER PUBLICATIONS

"Dave Pelz Putting Bible" Jul. 2000.

* cited by examiner

*Primary Examiner*—Raleigh W. Chiu
*Assistant Examiner*—Nini F. Legesse
(74) *Attorney, Agent, or Firm*—Senniger Powers Leavitt and Roedel

(57) ABSTRACT

A golf ball marking guide for use in making alignment markings on a golf ball. The guide has peripheral guide edges which facilitate simple marking of perpendicular lines, equatorial lines, and non-equatorial lines on a golf ball.

25 Claims, 14 Drawing Sheets

GOLF BALL MARKING GUIDE

This application claims benefit of Provisional application No. 60/308,533, filed Jul. 30, 2001.

BACKGROUND OF THE INVENTION

This invention relates to a golf ball marking guide that partially encapsulates a golf ball and, in the preferred embodiment, allows a golfer to easily mark a variety of straight lines and line patterns on the cover of a golf ball using a permanent ink marker. A golfer would then utilize the marking as an alignment aide while putting.

Many golfers utilize some marking on the golf ball to help with alignment, most commonly while putting. For example, on a straight putt, a golfer might aim a line on the golf ball directly towards the hole. This way when a golfer is standing over a putt, the golfer knows that the marking on the ball is pointed at the target and the golfer can then focus more on aligning the putter face with perceived target line and the speed of the putt. Lines and patterns can also be used to assist with alignment or execution of shots other than putts.

Among the variety of line combinations which golfers wish to mark on golf balls is a pattern consisting of two or more lines. In one instance the first such line corresponds to the equator of the golf ball and occupies 180 degrees or more and even up to 210 or 220 degrees of the golf ball circumference. The second line is non-equatorial, and is perpendicular to the first line. This allows the golfer to set the ball on the ground with the lines positioned so that the appearance of a "T" is presented when viewed from above. The first line of the "T" points toward the target, and the second line, perpendicular to the first line, advises the golfer of the precise position the club face should be in when aligning the shot. There are other patterns of interest which require drawing at least one non-equatorial line on the golf ball.

Currently golfers use different types of markings on their golf ball as alignment aides while putting: the manufacturer's logo, lines that were drawn freehanded using a permanent ink marker, and, more recently, lines drawn with aid of stencils.

Manufacturers' logos often are too small to be seen on the golf ball from a variety of locations on the putting surface if the golfer chooses to survey a putting attempt from more than one location on the green.

Hand drawn lines also tend to be relatively small and not straight. One main reason for this is the difficulty involved in drawing a perfectly straight line traveling half the circumference of a spherical object having hundreds of dimples on its surface. If the end result of a freehanded attempt is a line that is anything except perfectly straight, the golfer is essentially using a crooked line on the golf ball, compromising the line's effectiveness as an alignment aide. In view of the round shape of a golf ball, and in view of the dimples thereon, many golfers find drawing a straight line difficult, if not impossible. It is especially difficult to mark a straight line covering a significant portion of the circumference of a golf ball.

More recently stencils have become available such as those shown in U.S. Pat. Nos. 6,004,223, 6,213,012, and 6,216,587. Among the shortcomings of these devices is that they do not provide perpendicular line indicators, nor do they provide a means for readily drawing non-equatorial lines, nor do they provide a means for readily drawing non-equatorial lines perpendicular to equatorial lines.

In his book entitled The Putting Bible, pages 266–268, David Pelz discusses a golf ball stencil and its intended use.

The Pelz product is capable marking a non equatorial line on a golf ball, but only by a complex system that requires four lines on the ball.

SUMMARY OF THE INVENTION

It is an object of the invention to provide golfers a golf ball marking method and marking guide enabling long, straight, clean lines to be easily marked on a golf ball, as well as non-equatorial lines which are perpendicular to equatorial lines.

Briefly, therefore, the invention is directed to a golf ball marking guide for use in making alignment markings on a golf ball. The guide has a shell having an inner surface generally defining a portion of a sphere having a center of curvature and adapted for receiving a portion of a golf ball so that the inner surface substantially conforms thereto. The shell has a first peripheral guide edge for guiding marking of the golf ball and a second peripheral guide edge for guiding marking of the golf ball. The second peripheral guide edge is generally perpendicular to the first peripheral guide edge and positioned so that an arc having a constant radius from the center of curvature and extending from a center of the first peripheral guide edge to a center of the second peripheral guide edge has an angular extent greater than 90 degrees and less than 180 degrees. This arrangement facilitates the marking of a first line on the golf ball and a second line on the golf ball which second line is non-equatorial and perpendicular to said first line.

The invention is also directed to a golf ball marking guide for use in making alignment markings on a golf ball. The guide has a shell having an inner surface generally defining a portion of a sphere having a center of curvature and adapted for receiving a portion of a golf ball so that the inner surface substantially conforms thereto. The shell has a first peripheral guide edge for guiding marking of the golf ball and a second peripheral guide edge for guiding marking of the golf ball. The second peripheral guide edge is generally perpendicular to the first peripheral guide edge. The inner surface is sized to overlie a portion of the golf ball surface area which is greater than one fourth and less than one half thereby to facilitate the marking of a first line on the golf ball and a second line on the golf ball which second line is non-equatorial and perpendicular to said first line.

In another aspect the invention is a golf ball marking guide which has a shell having an inner surface generally defining a portion of a sphere having a center of curvature and adapted for receiving a portion of a golf ball so that the inner surface substantially conforms thereto. The shell has a first peripheral guide edge for guiding marking of the golf ball and a second peripheral guide edge for guiding marking of the golf ball. The second peripheral guide edge is generally perpendicular to the first peripheral guide edge. The body has an outer surface with indicia thereon to facilitate alignment of the marking guide relative to a line previously marked on the golf ball for use in marking of a first line and a second line, which second line is perpendicular to the first line.

The invention also encompasses a golf ball marking guide having a first guide edge for guiding marking of the golf ball and a second guide edge for guiding marking of the golf ball, wherein the first guide edge defines a first circular opening for receiving and seating the golf ball in a first position for marking, the second guide edge defines a second circular opening for receiving the golf ball and seating the golf ball in a second position for marking, the first circular opening has a first opening diameter which is smaller than the golf ball diameter, and the second opening has a second opening diameter which is smaller than the first opening diameter.

DETAILED DESCRIPTION OF THE PREFERRED EMBODIMENT

Turning now to FIGS. 1–6, there is a golf ball marking guide 1 for use in making alignment markings on a golf ball. Marking guide 1 comprises a shell having an inner surface generally defining a portion of a sphere having a center of curvature and adapted for receiving a portion of a golf ball. The inner surface substantially conforms to the shape of the portion of the golf ball received therein. The shell has a first peripheral guide edge 2 for guiding marking of the golf ball and a second peripheral guide edge 3 for guiding marking of the golf ball. The second peripheral guide edge 3 is generally perpendicular to the first peripheral guide edge 2. These figures show that these guide edges are exterior boundary guide edges which define exterior boundaries of the shell.

The second peripheral guide edge 3 is positioned so that an arc having a constant radius from the center of curvature and extending from a center of the first peripheral edge to a center of the second peripheral edge has an angular extent greater than 90 degrees and less than 180 degrees. This arc corresponds generally to the large curved peripheral line in FIG. 2. In one preferred embodiment the arc has an angular extent of between about 100 degrees and about 120 degrees. In another preferred embodiment the angular extent is between about 110 degrees and about 120 degrees. And in one particularly preferred embodiment, the angular extent is on the order of about 115 degrees. This arrangement facilitates the marking of a first line and a second line on the golf ball, wherein the second line is non-equatorial and is perpendicular to the first line.

The inner surface of the guide is preferably continuous in its entirety and is sized to overlie a portion of the golf ball surface area which is greater than one fourth and less than one half. In one preferred embodiment, the inner surface is sized to overlie about ⅔ of one hemisphere of the golf ball surface area.

The marking guide is preferably constructed from molded plastic by injection molding or other inexpensive manufacturing method.

Figure 7:
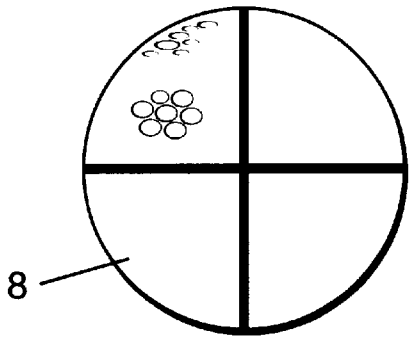
FIG. 7 is a top view of a golf ball after being marked with one possible marking.
Figure 9:
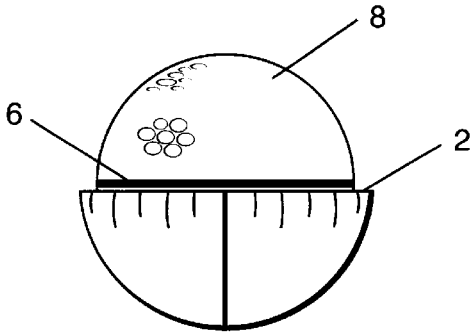
FIG. 9 shows how a golf ball would be marked using the equator edge of the golf ball marking guide.
Figure 10:
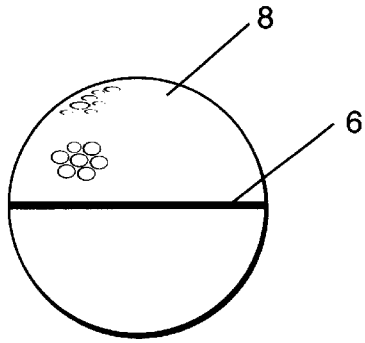
FIG. 10 shows a top view of a golf ball after being marked using the equator edge of the golf ball marking guide.
Figure 11:
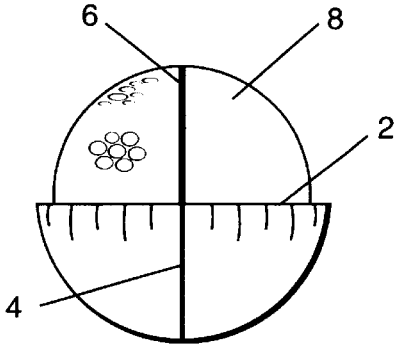
FIG. 11 is a front elevation of the golf ball marking guide with a golf ball having one previously marked line aligned with the perpendicular indicator.
Figure 12:
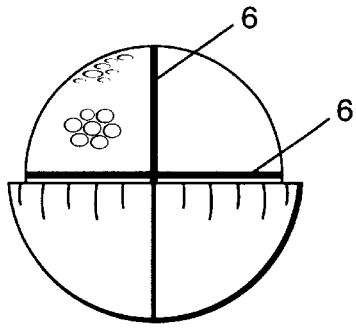
FIG. 12 shows how a golf ball would be marked using the equator edge of the golf ball marking guide twice.
Figure 13:
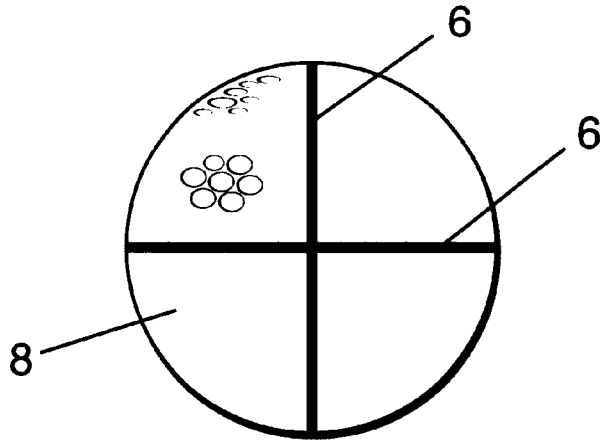
FIG. 13 shows a golf ball after being marked using the equator edge of the golf ball marking guide twice.

One method to use the device is illustrated in FIGS. 7 and 9–13. FIG. 7 shows a golf ball that has been marked twice using the first peripheral guide edge 2, also referred to as the equator edge, for both markings. First a golfer uses a permanent ink marker to trace around the equator edge 2 as illustrated in FIG. 9, to produce the line shown in FIG. 10, i.e., a single straight line marked on the equator of the golf ball 6. This line occupies up to 210 or 220 degrees around the circumference. The golfer then rotates the first line drawn on the golf ball ninety degrees until it is aligned with the perpendicular indicator 4 on the equator edge 2 as shown in FIG. 11. A second line is then marked along the equator edge as show in FIG. 12. FIG. 13 details the end result of using the equator edge twice to mark two perpendicular lines on a golf ball.

Figure 8:
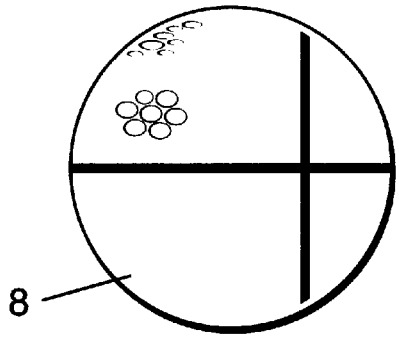
FIG. 8 is a top view of a golf ball after being marked with another possible marking.
Figure 14:
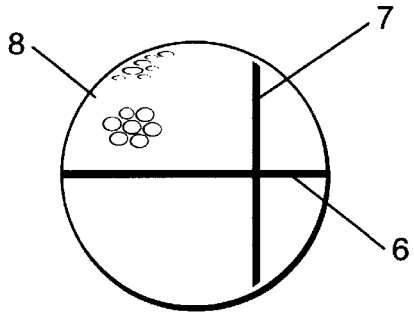
FIG. 14 is a top view of a golf ball after being marked once with the equator edge, and once with the non-equator edge of the golf ball marking guide.

FIG. 8 shows a golf ball which has been marked once with the first edge 2 and once with the second edge 3, also referred to as the non-equator edge. This pattern is marked on the ball and the ball is placed on the ground such that the equatorial line, line 6 in FIG. 14, is pointed at a target which would be to the left of the golf ball as it is viewed on this drawing page. The first line 6 corresponds to the equator of the golf ball and occupies up to about 210 or 220 degrees of the golf ball circumference. The second line 7 is non-equatorial, and is perpendicular to the first line. This allows the golfer to set the ball on the ground with the lines positioned so that the appearance of a "T" is presented when viewed from above. The first line 6 of the "T" points toward the target off to the left of the drawing. This helps remind the golfer of the direction in which the golf ball is to be propelled. The second line 7, perpendicular to the first line, advises the golfer of the precise position the club face should be in when aligning the shot.

Figure 15:
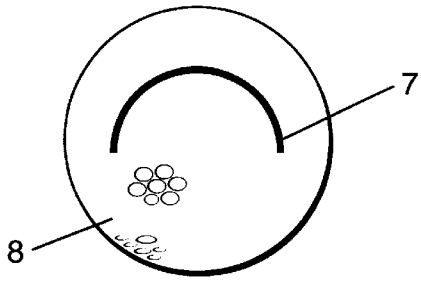
FIG. 15 is a side view of a golf ball after being marked with the non equator edge of the golf ball marking guide.
Figure 16:
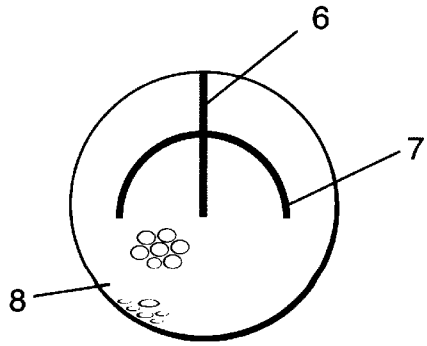
FIG. 16 is a side view of a golf ball after being marked once with the non equator edge, and once with the equator edge of the golf ball marking guide.

To leave a marking on a golf ball like the one in FIG. 8 the golf ball marking guide must have a guide edge that marks a non-equatorial line on the golf ball, and in such a way that it is perpendicular to an equatorial line. From this view in FIG. 8, the marking appears to be two straight lines on the golf ball. However, this is an optical illusion. FIG. 15 is a side view of a golf ball after it has been marked once with the non-equator edge of the marking guide. FIG. 15 shows the resulting line 7 is actually a half circle. FIG. 16 shows the relationship of the non-equatorial line to the equatorial line from a side of the golf ball.

Figure 17:
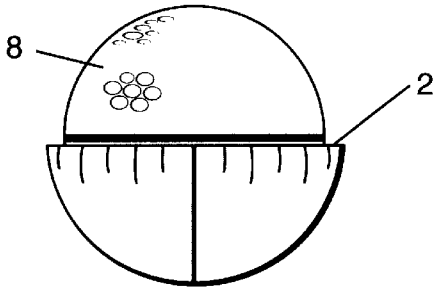
FIG. 17 shows how a golf ball would be marked using the equator edge of the golf ball marking guide.
Figure 18:
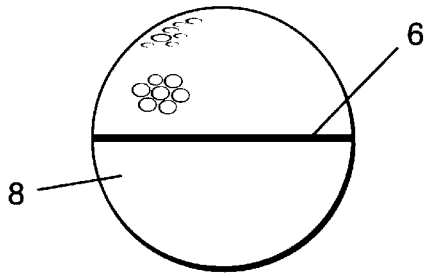
FIG. 18 shows a golf ball after being marked using the equator edge of the golf ball marking guide.
Figure 19:
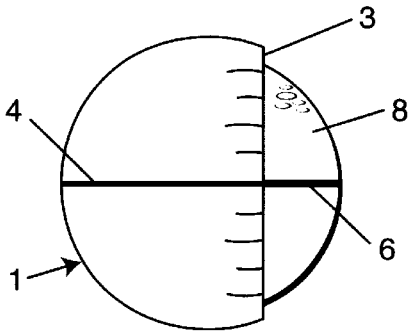
FIG. 19 is a front elevation of the golf ball marking guide with a golf ball having one previously marked line aligned with the perpendicular indicator on the non-equator edge.
Figure 20:
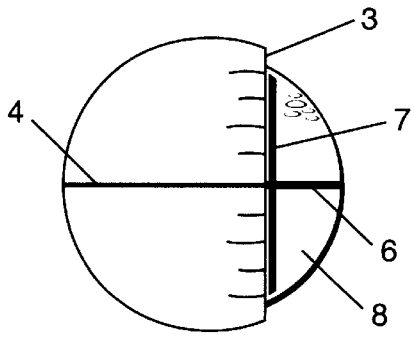
FIG. 20 shows how a golf ball would be marked using the non equator edge of the golf ball marking guide.
Figure 21:
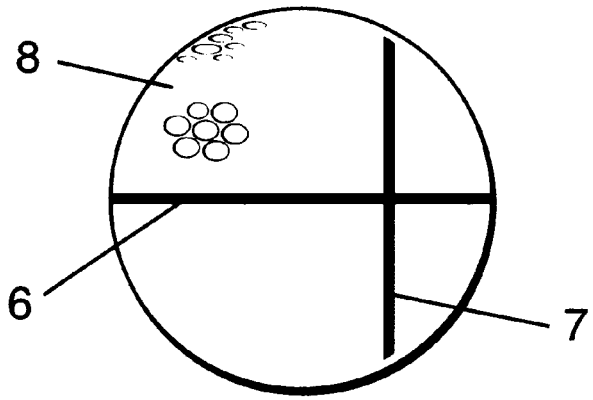
FIG. 21 is a top view of a golf ball after being marked once with the equator edge, and once with the non equator edge of the golf ball marking guide.
Figure 22:
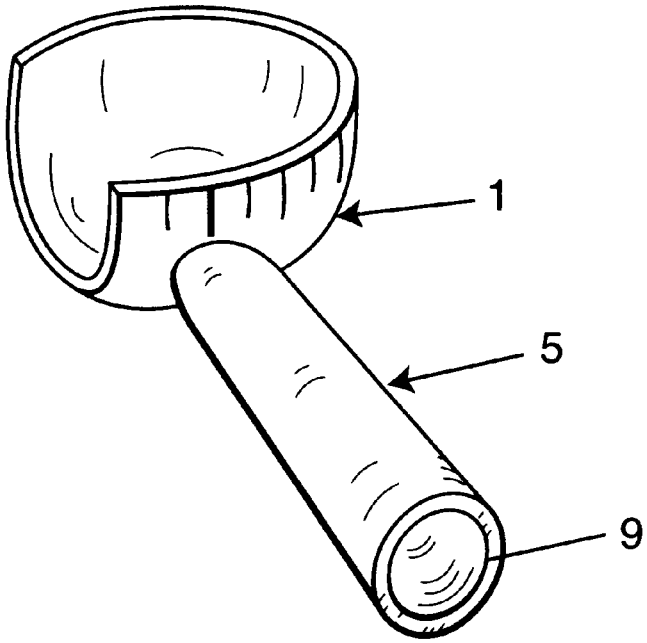
FIG. 22 is a perspective view of an alternative embodiment of the golf ball marking guide having an integrated pen cap.
Figure 23:
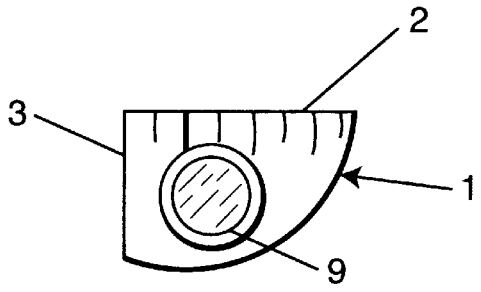
FIG. 23 is a side view of the alternative embodiment of the golf ball marking guide.
Figure 24:
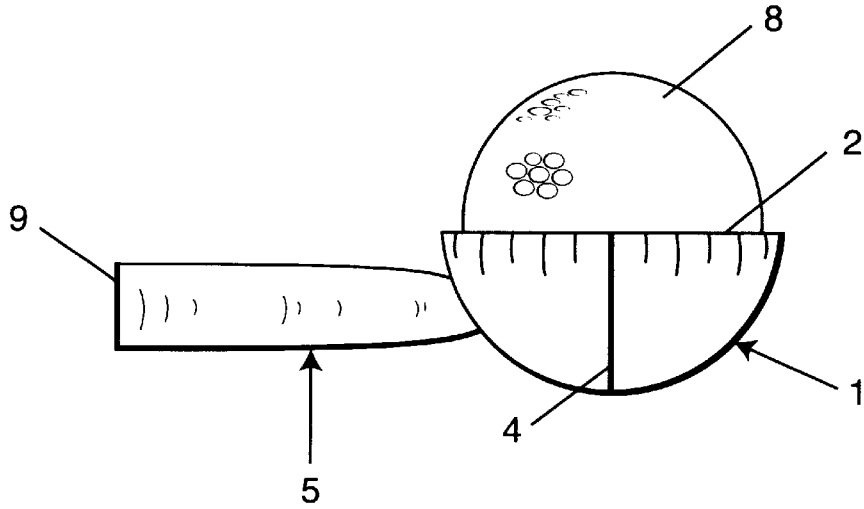
FIG. 24 is a front elevation of the alternative embodiment of the golf ball marking guide with a golf ball in the major portion of the golf ball marking guide.
Figure 25:
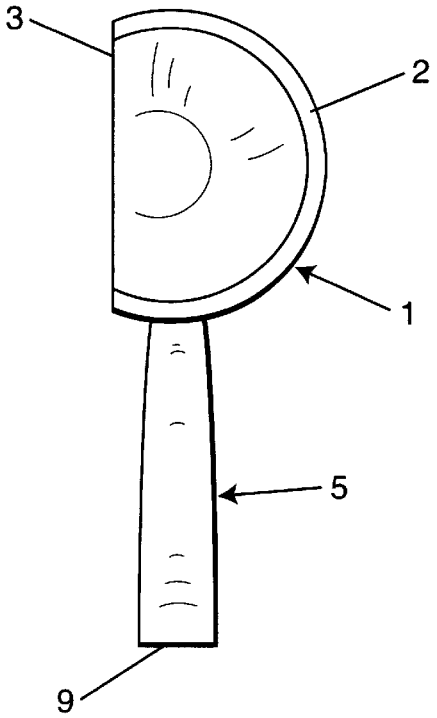
FIG. 25 is a top view of the alternative embodiment of the golf ball marking guide.
Figure 26:
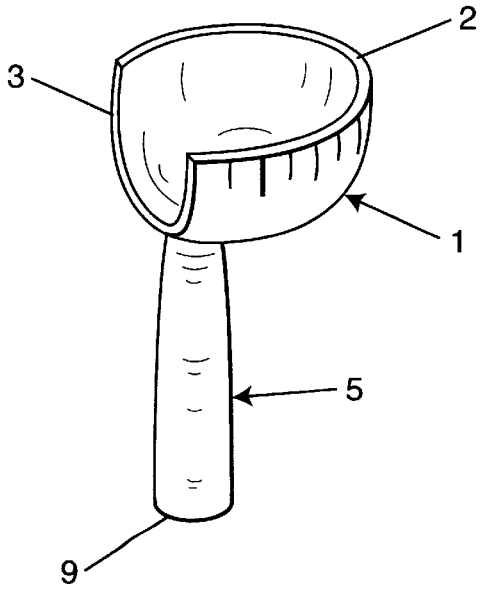
FIG. 26 is a perspective view of a second alternative embodiment of the golf ball marking guide.

FIGS. 17–21 detail how a golfer utilizes both guide edges 2 and 3 to yield a marking on the golf ball like that shown in FIGS. 8, 14, and 21. First an equatorial line is marked along the guide edge 2 on the ball 8 as shown in FIG. 17, yielding the line 6 in FIG. 18. Then the guide is placed on the ball (or the ball simply rotated within the guide) such that the equatorial line 6 is aligned with the perpendicular indicator 4 as in FIG. 19, and extends through the perpendicular indicator on both the first and second guide edges. The non-equatorial line 7 is then drawn along guide edge 3 as shown in FIG. 20, thus yielding the lines shown in FIG. 21. If an upper case "T" design is desired rather than the lower case "t" design of FIG. 21, the equatorial line is drawn as above, and then the ball is positioned so that the equatorial line terminates at, rather than extends through, the perpendicular indicator on the non-equatorial edge and extends through the perpendicular indicator on the equatorial edge.

Figure 5:
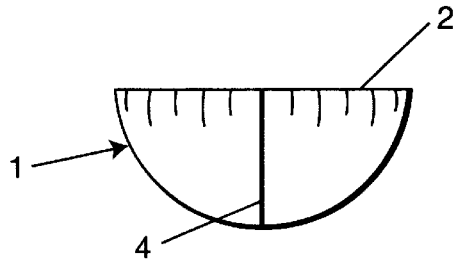
FIG. 5 is a front elevation of the golf ball marking guide.
Figure 6:
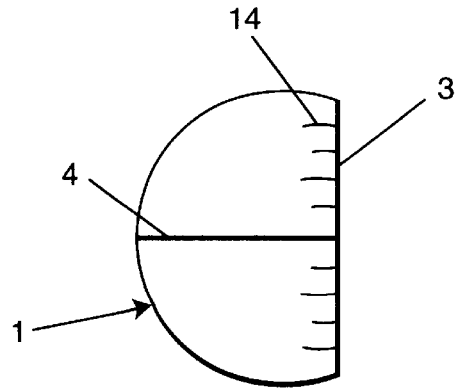
FIG. 6 is a top view of the golf ball marking guide detailing the non equator edge of the golf ball marking guide.

It can be seen in FIG. 5 that the guide has indicia along the first edge, equatorial edge 2. It is also seen that there are indicia along second edge, non-equatorial edge 3 (shown only in FIGS. 6, 19, and 20). These facilitate drawing lines of precise length. There is also the indicia which is perpendicular indicator 4. This indicia facilitates alignment of the marking guide relative to a line previously marked on the golf ball, as explained above in connection with the method for marking the lines in FIG. 21. It should be appreciated that these indicia all preferably indicate positions which are perpendicular to at least one of the first and second peripheral edges.

FIGS. 23–26 are various views of an alternative embodiment of the invention. These alternative embodiments relate to the invention further comprising an integrated pen cap for a permanent ink marker. The integrated pen cap 5 has an opening 9 that receives the felt tip portion of a permanent ink marker.

Figure 1:
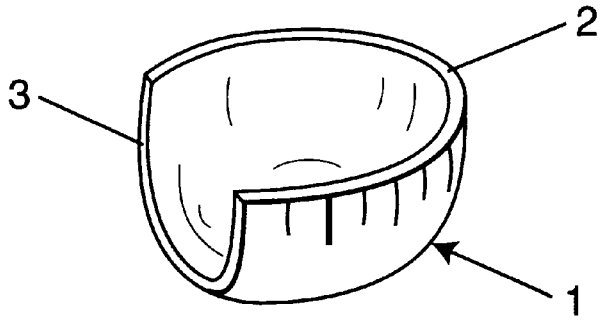
FIG. 1 is a perspective view of the golf ball marking guide of invention.
Figure 2:
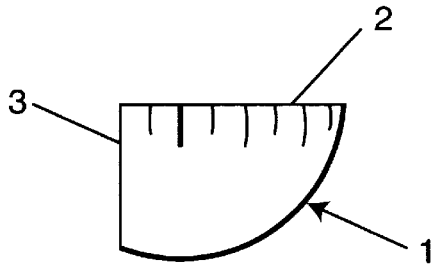
FIG. 2 is a side elevation of the golf ball marking guide.
Figure 3:
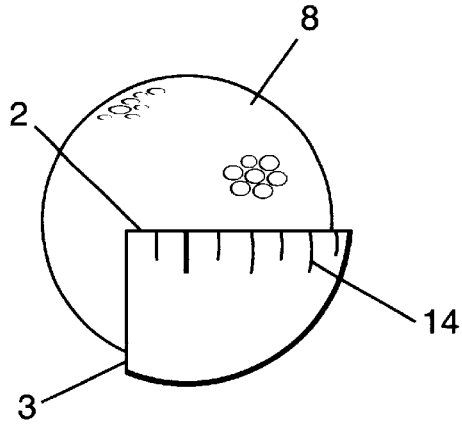
FIG. 3 is a side elevation of the golf ball marking guide with a golf ball in the major portion of the golf ball marking guide.
Figure 4:
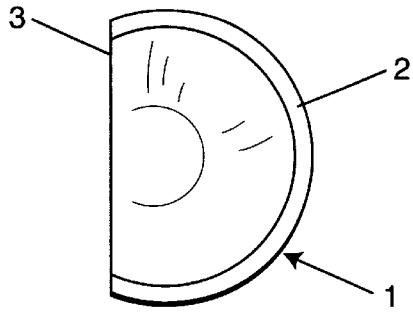
FIG. 4 is a top view of the golf ball marking guide.
Figure 27:
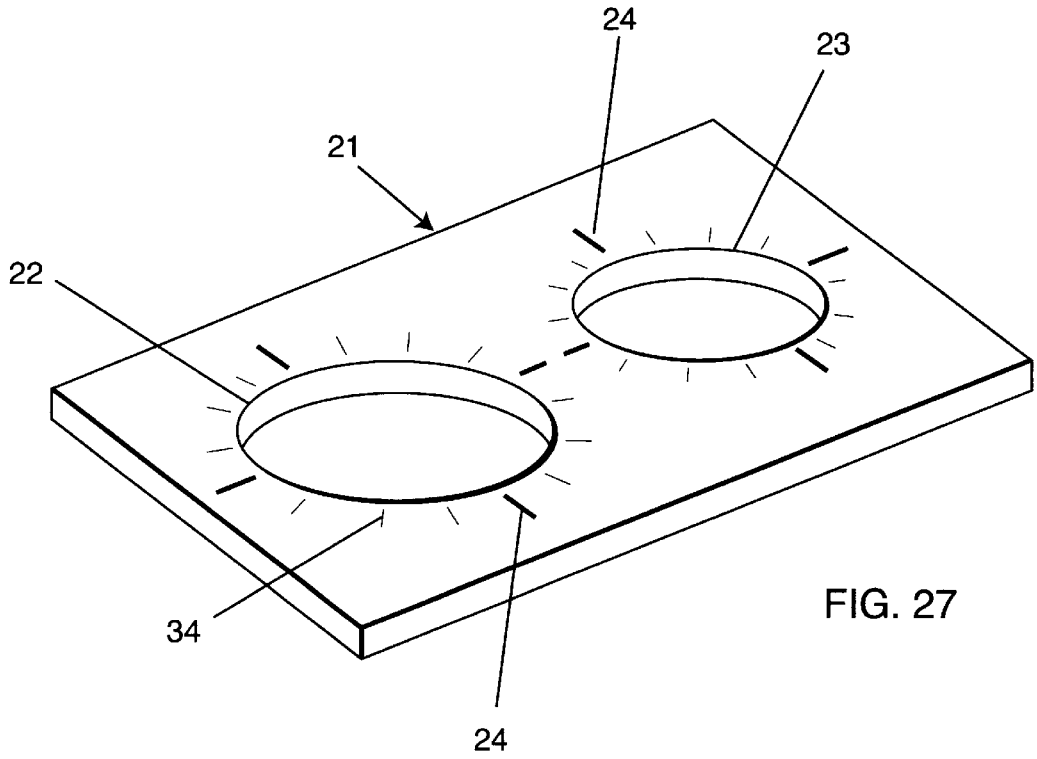
FIG. 27 is a perspective view of a third alternative embodiment of the golf ball marking guide.
Figure 28:
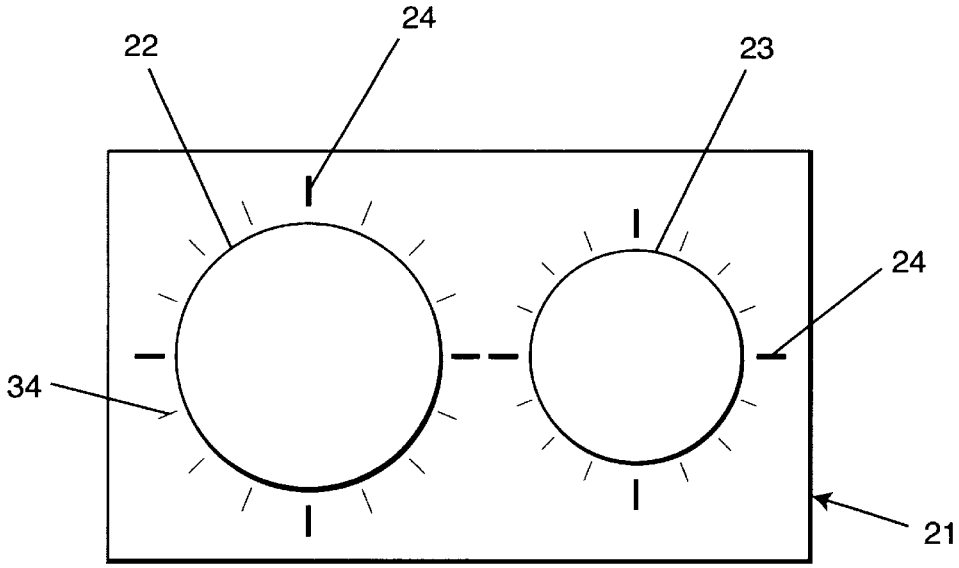
FIG. 28 is a top view of the third alternative embodiment of the golf ball marking guide.
Figure 29:
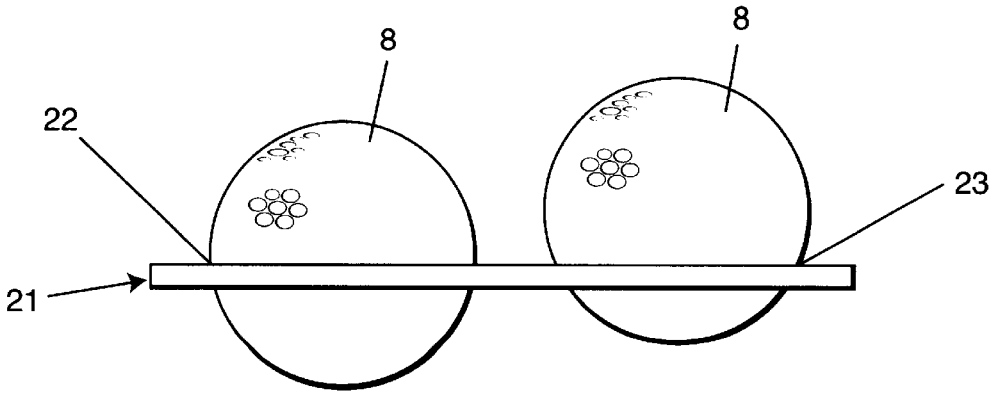
FIG. 29 is a side elevation of the third alternative embodiment of the golf ball marking guide with golf balls placed into both spaces of the main body of the golf ball marking guide.

FIGS. 27–29 are various views of an alternative embodiment of the invention. This embodiment, like the embodiment in FIG. 1, is designed to have two distinct tracing edges. One tracing edge 22 of the marking guide 21 permits a golfer to mark a line on the equator of the golf ball. The second tracing edge 23 allows the golfer to mark a line that is not on the equator of the golf ball. Tracing edge 22 corresponds to a larger diameter hole which receives a larger portion of the golf ball allowing a line to marked on the equator. The smaller diameter of the hole that comprises tracing edge 23 accepts a lesser portion of the golf ball allowing a line to be marked that is not on the equator of the golf ball. This second alternative embodiment still incorporates perpendicular indicators 24 and marked increments along both tracing edges 34. The first line is marked on the ball with the ball in the position as shown in the left of FIG. 29. Then the second line is drawn with the ball in the position shown on the right side of FIG. 29. The perpendicular indicator 24 is aligned with the first drawn line to facilitate placement of the ball in the right side of the guide in FIG. 29 so that the non-equatorial line is perpendicular to the equatorial line. This alternative embodiment is designed to have an overall thin and flat conformation to facilitate situations where such is desired for packaging reasons.

It can be appreciated from FIGS. 27–29 that the first guide edge 22 defines a first circular opening for receiving and seating the golf ball in a first position for marking, and that the second guide edge 23 defines a second circular opening for receiving the golf ball and seating the golf ball in a second position for marking. The first circular opening has a first opening diameter which is smaller than the golf ball diameter so that the golf ball seats snugly therein up to its equator without passing completely through the opening. The second opening has a second opening diameter which is smaller than the first opening diameter. The first opening diameter approaches the golf ball diameter to facilitate marking an equatorial line on the golf ball when the golf ball is seated in the first opening.

The marking guide edge has accompanying indicia 24 to facilitate alignment of the marking guide relative to a line previously marked on the golf ball. In one embodiment both the first and second guide edges have accompanying indicia 24 to facilitate alignment of the marking guide relative to a line previously marked on the golf ball. One preferred embodiment shown here also includes indicia 34 accompanying the first and/or the second opening to facilitate marking lines of predetermined length on the golf ball.

As various changes could be made in the above constructions without departing from the scope of the invention, it is intended that all matter contained in the above description or shown in the accompanying drawings shall be interpreted as illustrative and not in a limiting sense.

What is claimed is:

1. A golf ball marking guide for use in making alignment markings on a golf ball, the marking guide comprising a shell having an inner surface generally defining a portion of a sphere having a center of curvature and adapted for receiving a portion of a golf ball so that the inner surface substantially conforms thereto, the shell having a first exterior boundary guide edge for guiding marking of the golf ball and a second exterior boundary guide edge for guiding marking of the golf ball, the first and second exterior boundary guide edges defining exterior boundaries of the shell, the second exterior boundary guide edge being generally perpendicular to the first exterior boundary guide edge and positioned so that an arc having a constant radius from the center of curvature and extending from a center of the first exterior boundary guide edge to a center of the second exterior boundary guide edge has an angular extent greater than 90 degrees and less than 180 degrees thereby to facilitate the marking of a first line on the golf ball and a second line on the golf ball which second line is non-equatorial and perpendicular to said first line.

2. The golf ball marking guide of claim 1 wherein the angular extent of the arc is more than about 100 degrees and less than about 120 degrees.

3. The golf ball marking guide of claim 2 wherein the angular extent of the arc is about 115 degrees.

4. The golf ball marking guide of claim 1 wherein the inner surface is continuous in its entirety.

5. The golf ball marking guide of claim 1 wherein the inner surface is sized to overlie a portion of the golf ball surface area which is greater than one fourth and less than one half.

6. The golf ball marking guide of claim 5 wherein the inner surface is sized to overlie about ⅔ of one hemisphere of the golf ball surface area.

7. The golf ball marking guide of claim 6 wherein the inner surface is continuous in its entirety.

8. The golf ball marking guide of claim 1 wherein the first peripheral guide edge and second peripheral guide edge have indicia thereon to facilitate alignment of the marking guide relative to a line previously marked on the golf ball.

9. The golf ball marking guide of claim 8 wherein the indicia is arranged to indicate a position which is perpendicular to both the first and second exterior boundary guide edges.

10. The golf ball marking guide of claim 9 wherein the indicia is arranged to indicate the centerpoint of both the first and second exterior boundary guide edges.

11. The golf ball marking guide of claim 8 wherein the indicia comprises plural marks on the outer surface, each mark indicating an orientation which is perpendicular to at least one of the first and second exterior boundary guide edges.

12. The golf ball marking guide of claim 8 wherein the inner surface is continuous in its entirety.

13. The marking guide of claim 1 comprising an integrated pen cap.

14. A golf ball marking guide for use in making alignment markings on a golf ball, the marking guide comprising a shell having an inner surface generally defining a portion of a sphere adapted for receiving a portion of a golf ball so that the inner surface substantially conforms thereto, the shell having a first exterior boundary guide edge for guiding marking of the golf ball and a second exterior boundary guide edge for guiding marking of the golf ball, the first and second exterior boundary guide edges defining exterior boundaries of the shell, the second exterior boundary edge being generally perpendicular to the first exterior boundary edge, the inner surface being sized to overlie a portion of the golf ball surface area which is greater than one fourth and less than one half thereby to facilitate the marking of a first line on the golf ball and a second line on the golf ball which second line is non-equatorial and perpendicular to said first line.

15. The golf ball marking guide of claim 14 wherein the inner surface is sized to overlie about ⅔ of one hemisphere of the golf ball surface area.

16. The golf ball marking guide as set forth in claim 15 wherein the inner surface is continuous in its entirety.

17. The golf ball marking guide of claim 14 wherein the second exterior boundary guide edge is generally perpendicular to the first exterior boundary guide edge and positioned so that an arc having a constant radius from the center of curvature and extending from a center of the first exterior boundary guide edge to a center of the second exterior boundary guide edge has an angular extent greater than about 110 degrees and less than 120 degrees.

18. The golf ball marking guide of claim 14 wherein the first peripheral guide edge and second peripheral guide edge have indicia thereon to facilitate alignment of the marking guide relative to a line previously marked on the golf ball.

19. The golf ball marking guide of claim 18 wherein the indicia is arranged to indicate a position which is perpendicular to both the first and second exterior boundary guide edges.

20. The golf ball marking guide of claim 19 wherein the indicia is arranged to indicate the centerpoint of both the first and second exterior boundary guide edges.

21. A golf ball marking guide for use in making alignment markings on a golf ball, the marking guide comprising a shell having an inner surface generally defining a portion of a sphere adapted for receiving a portion of a golf ball so that the inner surface substantially conforms thereto, the shell having a first exterior boundary guide edge for guiding marking of the golf ball and a second exterior boundary guide edge, the first and second exterior boundary guide edges defining exterior boundaries of the shell, the second exterior boundary edge being generally perpendicular to the first exterior boundary, the shell having an outer surface with indicia thereon to facilitate alignment of the marking guide relative to a line previously marked on the golf ball for use in marking of a second line, which second line is perpendicular to the first line.

22. The golf ball marking guide of claim 21 wherein the indicia is arranged to indicate a position which is perpendicular to both the first and second exterior boundary guide edges.

23. The golf ball marking guide of claim 22 wherein the indicia comprises plural marks on the outer surface, each mark indicating an orientation which is perpendicular to at least one of the first and second exterior boundary guide edges.

24. The golf ball marking guide of claim 22 wherein the inner surface is continuous in its entirety.

25. The golf ball marking guide of claim 21 wherein the inner surface is sized to overlie about ⅔ of one hemisphere of the golf ball surface area.

* * * * *